United States Patent [19]

Lorch

[11] 3,939,478

[45] Feb. 17, 1976

[54] ILLUMINATED MOBILE CONSTRUCTION

[76] Inventor: Leonard G. Lorch, 115 Lafayette Place, Woodmere, N.Y. 11598

[22] Filed: July 5, 1974

[21] Appl. No.: 485,774

[52] U.S. Cl. ..... 343/721; 240/78 E

[51] Int. Cl.[2] ..... H01Q 1/06

[58] Field of Search ..... 240/78 R, 78 E; 343/701, 343/721

[56] References Cited

UNITED STATES PATENTS

| | | | |
|---|---|---|---|
| 2,525,624 | 10/1950 | Stahl et al. | 343/701 |
| 3,813,478 | 5/1974 | Ervin | 240/78 E |
| D90,844 | 10/1933 | Gruber | 240/78 R |

*Primary Examiner*—Eli Lieberman
*Attorney, Agent, or Firm*—Charles E. Temko

[57] ABSTRACT

A decorative mobile formed of interconnected planar members arranged for relative movement and normally supported from a single point on the ceiling of a room, or other supporting location. The individual planar members are of laminated construction, including a centrally disposed base having a printed circuit on at least one surface thereof, the conductors of which extend outwardly on elongated tabs to provide electrical connections to adjacent mechanically interconnected planar members. Mechanical elongated linkage means is provided performing the dual function of completely enclosing the electrical communication between adjacent members, and providing for relative movement about the principal axis of the linkage. At least some of the planar members are provided with incandescent lamps engaging sockets or otherwise communicating with the printed circuitry of the respective planar member. In normal use, the mobile is supported from an electrical outlet communicating with the circuitry. Power transmission by inductive means is also contemplated.

6 Claims, 18 Drawing Figures

ILLUMINATED MOBILE CONSTRUCTION

BACKGROUND OF THE INVENTION

Planar mobile structures are known in the art, and harnesses for holding a plurality of incandescent bulbs for such applications as Christmas tree illumination and the like are also well known. The traditional chandelier used for illumination of a room is generally of rigid structure, albeit it is sometimes interconnected by flexible linkage from a ceiling outlet, and is therefore of limited utility as a medium of expression for abstract and contemporary art forms as well as illumnation purposes.

SUMMARY OF THE INVENTION

Briefly stated, the invention contemplates the provision of a mobile adapted to be supported from a ceiling outlet, the mobile being comprised of a plurality of planar forms interconnected for relative pivotal movement under the influence of air currents or other impetus, the interconnecting linkage providing not only mechanical connection between the parts, but electrical communication as well, the latter being completely shielded within the former in such manner as to be undisburbed by the relative movement between the interconnecting parts. The planar parts are formed in laminated fashion, and enclose a printed circuitry adapted at predetermined points to communicate with incandescent lamp sockets, light-emitting diodes or other luminous devices. When the structure is not used as a chandelier, and a self-contained source of power is not feasible, the printed circuitry may be so configured as to serve as an antenna for the reception of power transmitted by radio frequency inductive means.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
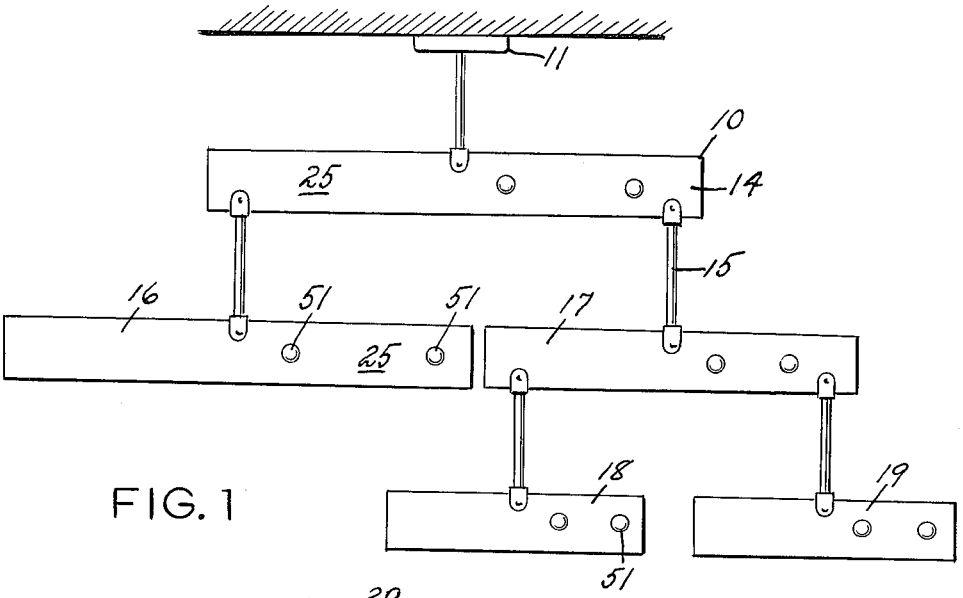
FIG. 1 is a fragmentary view in elevation, somewhat schematic of a first embodiment of the invention.

In accordance with the first embodiment of the invention, the device, generally indicated by reference character 10 is illustrated in FIG. 1 in the drawings interconnected to a conventional electrical outlet box 11 mounted in a ceiling 12 of a room. The outlet box supports and electrically communicates with a conventional cord (not shown) in well known manner, the cord being interconnected with printed circuitry to be described hereinbelow. The device 10 may be of any desired configuration, depending upon considerations of artistic expression and desired size, and includes a first planar member 14 interconnected by linkages 15 to second, third, fourth and fifth members 16, 17, 18 and 19, respectively. It will be understood that the configuration illustrated in FIG. 1 is purely exemplary, and may be varied at will by those skilled in the art.

Figure 2:
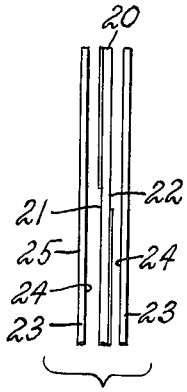
FIG. 2 is an enlarged exploded end elevational view of one of the planar mobile members comprising parts of the embodiment.
Figure 3:
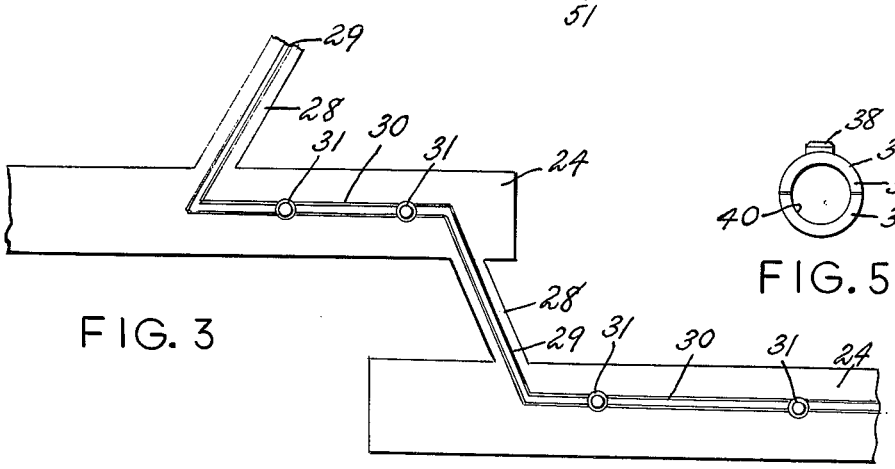
FIG. 3 is an enlarged fragmentary view in elevation of unitary printed circuitry forming a part of the embodiment.
Figure 5:
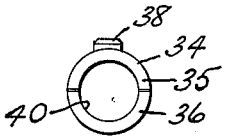
FIG. 5 is a bottom plan view as seen from the lower portion of FIG. 4.
Figure 4:
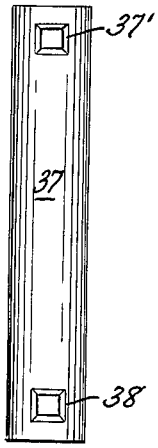
FIG. 4 is a view in elevation of an elongated hollow tube forming part of linkage means for interconnecting a pair of adjacent planar members.
Figure 6:
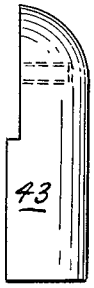
FIG. 6 is a view in elevation of part of a junction member used for interconnecting the linkage tube of FIG. 4 with a planar member.
Figure 8:
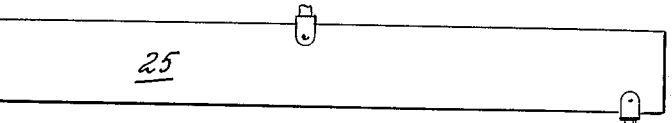
FIG. 8 is a bottom plan view as seen from the lower portion of FIG. 7.
Figure 8:
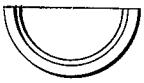
Figure 10:
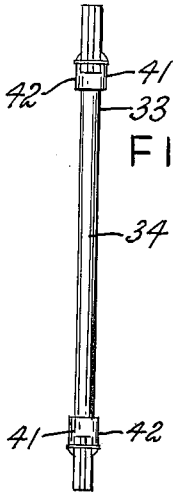
FIG. 10 is an end elevational view as seen from the right portion of FIG. 9.
Figure 9:
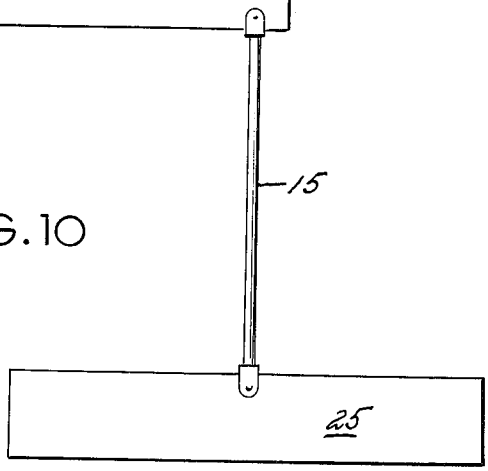
FIG. 9 is an enlarged fragmentary view in elevation corresponding to the lower left hand portion of FIG. 1.
Figure 7:
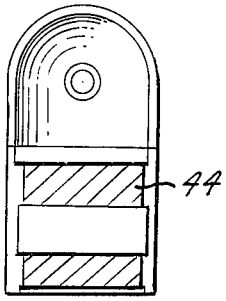
FIG. 7 is a view in elevation as seen from the left hand portion of FIG. 6.

Referring to FIG. 2, each of the members 14 and 16 to 19, inclusive, is generally similar, including a centrally disposed planar member 20 of synthetic resinous material and being mounted by first and second surfaces 21 and 22, either or both of which carry a printed electrically conductive circuit of well known type. The circuit may be formed in any desired manner, including vacuum deposition, etching, and the like. Overlying and protecting the surfaces 21 and 22 are a pair of outer decorative members 23, the inner surface 24 of each being adhered to the member 20, and the outer surfaces 25 being suitable decorated, by metallizing or the like. Where the printed circuitry has been suitably insulated, the outer members 22 may be formed of metal. Referring to FIG. 3 in the drawings, the planar members 24 each of the members 14 and 16–19, inclusive, may be formed integrally to include interconnecting sections 28 each having a pair of conductors 29 on either or both surfaces to establish communication between adjacent members 20. The circuitry printed on the members 20, generally indicated by reference character 30, may be of any desired configuration, and may communicate with lamp sockets 31 disposed in congruent relation with corresponding openings in the outer members 23. Where the members 23 are of metallic construction, a suitable insulative coating (not shown) is employed to cover the conductors to prevent short circuiting.

Figure 11:
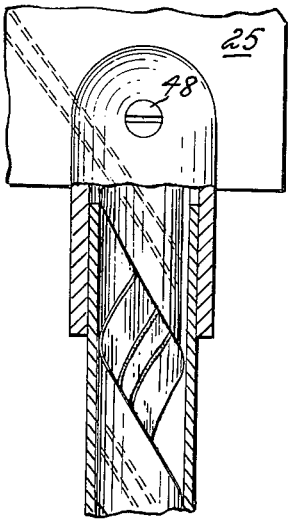
FIG. 11 is an enlarged fragmentary sectional view, partly in elevation, corresponding to the upper right hand portion of FIG. 9, as showing the communication of printed circuitry means through the linkage shown in FIG. 10.
Figure 12:
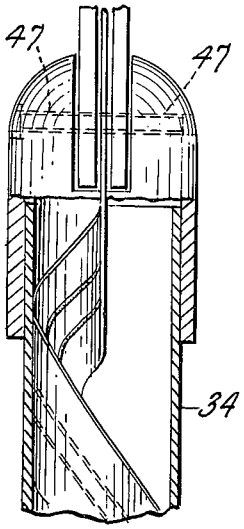
FIG. 12 is a fragmentary view in elevation, partly in section, as seen from the left portion of FIG. 11.

Referring to FIGS. 4 to 10, inclusive, there is illustrated in detail linkage means 33 employed for interconnecting the planar decorative members 13, and 15 through 19, inclusive. Each linkage element includes an elongated tube 34 of split configuration including first and second parts 35 and 36. The outer surface 37 mounts a pair of key protuberances 37, and 38. The inner surface 40 is cylindrical bore which accommodates the interconnecting sections 28 in spiralled or coiled form. Each tube 34 engages at each end thereof first and second junction members 41 and 42, respectively, which are generally similar and symmetrical. Each member is bounded by an outer surface 43 and cylindrical surface 44 which forms a bearing to permit relative rotation of the tube 34. The first member 41 includes a key way which engages one of the protuberances 38–39, while the second member 42 is devoid of this construction. Thus, when fully assembled, the protuberances 38–39 move within a respective key way, permitting slightly less than 180° relative rotation at each end of the linkage. The limits of pivotal rotation can be increased, by suitable modification of the length of the key ways to slightly less than 360° each, but it will be understood that some limitations on pivotal rotation must be made in order to prevent damage to the interconnecting sections 38 disposed within the tubes 34. FIGS. 11 and 12 show the installation of the interconnecting section 28 within the tube 34 of a single linkage element. The device may be assembled after laminations of the members 14 and 16–19, inclusive, by twisting the sections 28 to spiral form, and placing them between the first and second parts 35 and 36 of the tube 34. The members 41 and 42 are then assembled, to engage the tube 34 at each end and form an interstice into which an edge of the planar member is inserted, following which a screw or rivet 48 is inserted into co-axially aligned bores 47. Commencing with the uppermost linkage, this process is repeated to establish communication with each successive pendant member therebelow until the entire device is assembled.

Figure 13:
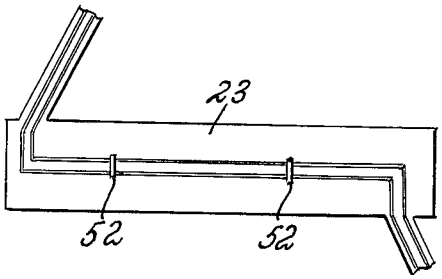
FIG. 13 is a fragmentary view in elevation, corresponding to that seen in FIG. 3, but showing an alternate form of construction.

During the lamination of the members 14 and 16–19, inclusive, position of the support of illumination means is made by having an exposed portion 51 of the sockets communicating with the printed circuit means project outwardly of the outer surfaces 25 of the members 23. In the alternate form of the first embodiment shown in FIG. 13, lamp sockets are elimminated, and wires communicating with the printed circuitry project outwardly of the outer surfaces 23 to interconnect with light emitting diodes which are mounted on said outer surfaces.

Figure 14:
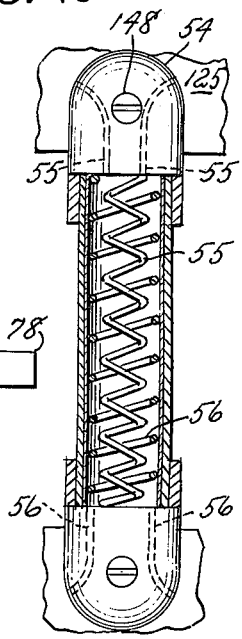
FIG. 14 is a view in elevation of a second embodiment of the invention.

Turning now to the second embodiment of the invention, illustrated in FIG. 14, and generally indicated by reference character 54, this embodiment differs from the first embodiment in the illumination of electrical communication between the planar decorative members, and the shaping of the printed circuit means to act as an antenna for the reception of radiant radio frequency energy. This embodiment is particularly suitable when the device 54 is not used as a chandelier, but as a mobile supported from a point which does not communicate with a source of electrical energy. A radio frequency transmitter (not shown) is disposed in the area of the embodiment, and with movement of the component parts, the amount of energy transmitted will vary as a function of the angle of the printed circuit which serves as an antenna with respect to the direction of the waves of transmitted energy emanating from the transmitter. As disclosed in FIG. 14, the antenna 55 for each light emitting diode 56 is in the form of a simple dipole, although other configurations may be used if desired.

Figure 15:
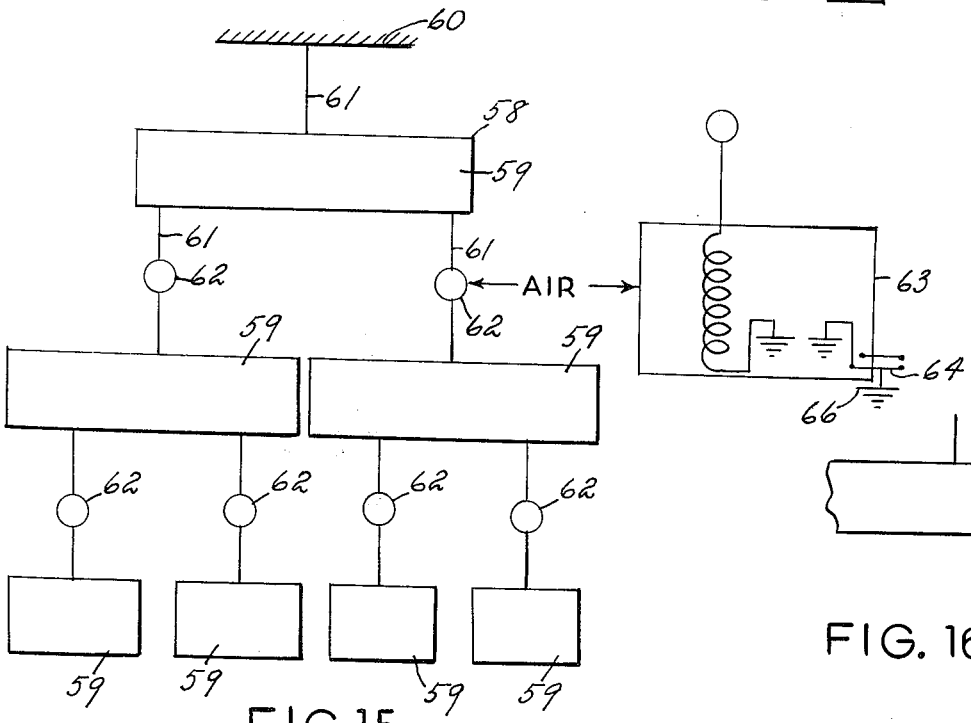
FIG. 15 is a schematic view showing a third embodiment of the invention.

Turning now to the third embodiment, generally indicated by reference character 58, and illustrated in FIG. 15, this embodiment is particularly suitable for use in installations where direct connection to a power source is not possible or convenient. The planar members are in the form of metallized leaves 59, the uppermost one being connected to an earth ground at 60. The wires serve both as electrical and mechanical interconnection between the leaves 59, and at least some of the same are provided with series connected neon lamps 62. A radio frequency transmitter 63 has one power line 64 also earth grounded at 66.

Figure 16:
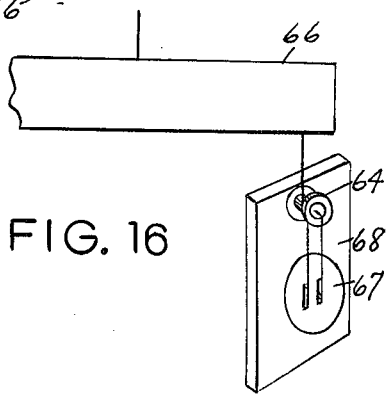
FIG. 16 is a fragmentary schematic view showing a fourth embodiment of the invention.

In the fourth embodiment illustrated in FIG. 16, and generally indicated by reference character 66, the neon glow devices 67 are mounted directly upon a metalized leaf 68, and insulated therefrom by a grommet 64, for those installations where it is desired to have the illumination directly on the leaf, rather than between adjacent leaves.

Figure 17:
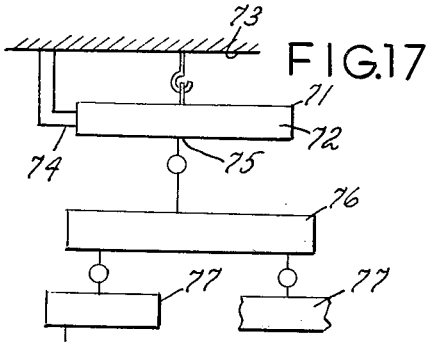
FIG. 17 is a fragmentary schematic view showing a fifth embodiment of the invention.

In the fifth embodiment, generally indicated by reference character 71, is illustrated in FIG. 17. A radio frequency trasmitter 72 is suspended directly from a ceiling 73 which forms an earth ground, leaving only a power line 74 exposed. A "hot" radio frequency terminal 75 supports the uppermost leaf 76 connected to the remaining leaves 77 as in the third embodiment.

Figure 18:
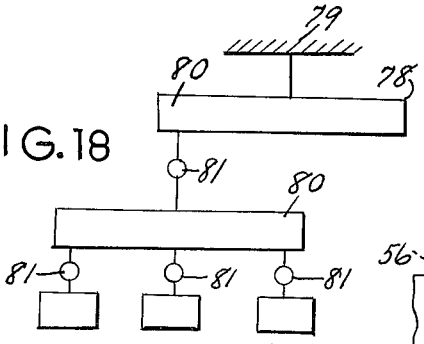
FIG. 18 is a fragmentary schematic view showing a sixth embodiment of the invention.

The sixth embodiment, illustrated in FIG. 18, and generally indicated by reference character 78 employs an earth ground 79, a plurality of leaves 80 and a plurality of neon glow devices 81 which may be interconnected in any desired manner of series power connection. Should any noen glow device become inoperative, the remaining devices will remain illuminated so long as ther is at least one connection to the earth ground.

I wish it to be understood that I do not consider the invention limited to the precise details of structure shown and set forth in this specification, for obvious modifications will occur to those skilled in the art to which the invention pertains.

I claim:

1. As a new article of manufacture, an illuminated mobile comprising: a plurality of generally planar mobile members, one of said members having means for pendant attachment from a relatively fixed point, linkage means interconnecting said planar members for relative orbital movement about said point, at least some of said planar members being of laminated configuration, and including a medially disposed layer having electrically conductive circuit means thereon and means communicating with electrically conductive circuit means on at least one other of said planar mobile members, said last mentioned means being co-axially disposed with respect to a linkage means interconnecting to adjacent planar members.

2. Structure in accordance with claim 1, in which said last mentioned means is spirally disposed within said linkage means.

3. Structure in accordance with claim 1, in which said linkage means includes an elongated hollow tube having first and second ends, at least one of said ends having thereon a junction member mounted for pivotal movement relative to said tube, and having means for engaging at least one planar surface of a mobile member in an area adjacent an edge thereof.

4. Structure in accordance with claim 3, in which said junction member and shaft include cooperating means for limiting the degree of pivotal rotation.

5. Structure in accordance with claim 3, in which said junction member includes a pair of symmetrically disposed portions defining an interstice into which an edge of a mobile member is inserted, and screw means bridging said interstice and penetrating said mobile member.

6. In a mobile including a pair of members interconnected for relative pivotal movement in accordance with claim 1, the improvement comprising: at least one of said members being of generally planar configuration, and including antenna means thereon for the reception of radiant radio frequency energy; and luminescent means interconnected to said antenna means and powered by said energy.

* * * * *